United States Patent [19]

Apfel et al.

[11] Patent Number: 4,794,696

[45] Date of Patent: Jan. 3, 1989

[54] GUIDE BAR FOR A MOTOR-DRIVEN CHAIN SAW

[75] Inventors: Norbert Apfel; Hans-Peter Stehle, both of Waiblingen; Ralf-Rainer Kemmler, Althütte, all of Fed. Rep. of Germany

[73] Assignee: Stihl Andreas, Waiblingen, Fed. Rep. of Germany

[21] Appl. No.: 36,348

[22] Filed: Apr. 9, 1987

[30] Foreign Application Priority Data

Apr. 10, 1986 [DE] Fed. Rep. of Germany ..... 3612024

[51] Int. Cl.[4] ..... B27B 17/02

[52] U.S. Cl. ..... 30/387; 30/383

[58] Field of Search ..... 30/381, 383, 387

[56] References Cited

U.S. PATENT DOCUMENTS

| | | | |
|---|---|---|---|
| 3,416,578 | 12/1968 | Irgens | 30/387 |
| 3,473,581 | 10/1969 | Merz | 30/387 |
| 4,693,007 | 9/1987 | Apfel et al. | 30/387 |

FOREIGN PATENT DOCUMENTS

| | | | |
|---|---|---|---|
| 657445 | 2/1963 | Canada | 30/387 |
| 1136812 | 9/1962 | Fed. Rep. of Germany | 30/387 |
| 213969 | 6/1941 | Switzerland | 30/387 |

*Primary Examiner*—Frank T. Yost
*Assistant Examiner*—Michael D. Folkerts
*Attorney, Agent, or Firm*—Walter Ottesen

[57] ABSTRACT

The guide bar for a motor-driven chain saw is provided for taking highest loading and is therefore made of solid material. For weight reduction, openings are provided in the guide bar which are closed off by cover plates that are flush with the flat sides of the guide bar. The cover plates are firmly joined to the base plate of the guide bar. By means of the hollow spaces inside the guide bar, a considerable weight reduction is attained, yet the stability of the guide bar is not substantially impaired as compared to a solid guide bar, since the hollow spaces are located in the zone that is neutral in terms of bending.

10 Claims, 4 Drawing Sheets

GUIDE BAR FOR A MOTOR-DRIVEN CHAIN SAW

FIELD OF THE INVENTION

The invention relates to a guide bar for a motor-driven chain saw and is made of solid material. The guide bar has two flat sides and a narrow end face and at least one opening extending into the two flat sides to reduce its weight.

BACKGROUND OF THE INVENTION

Guide bars of this kind are used to guide a revolving saw chain. They are secured with one end inside the motor-driven chain saw and from there project freely to the front for their entire length. Because it is attached at one end in this way, the guide bar has to withstand major forces, particularly when it is loaded at its free end as in plunge-cutting work. If the guide bar should catch in the kerf for example, very severe bending and/or torsional strains may be imparted to the guide bar; the longer the guide bar, the greater the effect of the strains will be.

For these reasons, the guide bar must be extremely sturdy in design, which makes it correspondingly heavy; especially with hand-operated motor-driven chain saws, this is highly disadvantageous because it makes them more difficult to manipulate. Attempts have therefore long been made to reduce the relatively great weight of the guide bar.

Initial attempts to reduce the weight included providing openings in the form of penetrations through the flat side of the guide bar; however, this soon proved unsuitable because this considerably lessened the bending strength of the guide bar and made it less resistant to torsion. Thereafter attempts to increase the stability were made by filling the openings of the guide bar, which as a rule was of solid material such as steel, with lighter-weight materials such as light metal. Guide bars of this kind are disclosed, for example, in German Pat. No. 728,639 and Canadian Pat. No. 657,445. Although it was possible with such embodiments to attain a notable weight reduction as compared with solid steel guide bars, these embodiments with lighter-weight metal inserts have not proved satisfactory in practice because they did not provide the required stability.

It is also known for motor-driven chain saw guide bars that are fastened at one end to be made up of several pieces, preferably three, instead of only one piece. Guide bars of this kind are of sandwich construction such that the two outer parts of the guide bar have closed faces, while a spacer plate is placed in the interior between these closed outer faces; the spacer plate is also made of steel but has openings to effect a reduction in weight. These three layers are preferably joined together to form a unit by means of welding.

Although such versions can be much lighter than solid guide bars, they still lack the rigidity of solid guide bars, which must be capable of withstanding maximum loads in long-term use. It has also been found that in multi-layer guide bars, the rigidity of the guide groove is not entirely satisfactory because the groove widens after relatively long use and the reliable guidance of the saw chain that is required is no longer assured. These sandwich-construction guide bars are therefore no longer used where highest loading of the apparatus is expected.

SUMMARY OF THE INVENTION

In view of the above, it is an object of the invention to provide a one-piece, heavy-duty guide bar of solid material in which the guide groove for the saw chain is produced by metal-cutting methods, such as milling or grinding. One-piece guide bars of this kind are used in motor-driven chain saws for highest loading, in particular where maximum bending strains are involved.

It is another object of the invention to provide a guide bar for use under highest loading which is configured such that a significant weight reduction is attained without lessening its rigidity, in particular, its bending strength and torsional strength.

According to a feature of the invention, an opening is provided on each of the two flat sides of a main member of the guide bar and the opening is covered on both sides with a plate that is flush with the flat side and the total thickness of the two cover plates is less than that of the guide bar.

By means of this embodiment, a significant weight reduction is attained in comparison to a guide bar that is not so penetrated and at the same time it is possible to satisfy all the requirements as to strength made of a guide bar of solid material. This is a considerable advantage, especially with long guide bars because the entire machine can be made lighter and easier to handle in this way. This is brought about by a more favorable position of the center of gravity. Since the strength achieved is nearly that of a solid guide bar, the same loads can be borne by such a guide bar, or in other words the same work can be performed, and handling of the machine, especially during long periods of use, is made considerably easier.

An opening closed off by plates is advantageously disposed symmetrically with respect to the longitudinal central plane of the guide bar; as a result, not only is there a symmetrical distribution of the weight of the guide bar itself, but the reduction of material is effected in the neutral zone, where there is practically no effect on the stability.

If the cover plates for the opening are made from the same material as the guide bar itself, then it has proved to be advantageous to select a material thickness of the plates that is approximately one-third that of the guide bar. For still further weight reduction, the cover plates can also be made of higher alloy material than the basic material of the guide bar, so that the same stability is attained even with cover plates of lesser thickness.

Both in terms of guide bar manufacture—with cover plates being fastened in the openings—and of the load involved in operation, it is especially advantageous to provide a spacer between two cover plates, which braces the plates against one another and defines the location of the plates relative to one another. The spacer between two plates may be embodied as a separate part or may be integral with the guide bar. In the integral embodiment, it is particularly advantageous to configure the spacer as a protruding rim in the periphery of the opening, which is inexpensive to manufacture by stamping, that is by pressing, from the solid material comprising the guide bar. Such a rim extending around the opening forms a bearing surface over the entire outer periphery of the plates, which braces them relative to one another, and by which they can be fastened to the guide bar in a simple manner, since special holders for a fitted insertion of the plates are unnecessary. Especially when the plates are fastened by gluing or soldering, the fastening area of the plates is enlarged still further, so that the strength of the connection can be increased.

Instead of the encompassing rim, the spacer may also be configured by a plurality of protrusions stamped into the periphery of the opening, which are likewise provided for receiving the plates thereagainst and bracing them against one another. Once again, these protrusions are preferably stamped out from the material of the solid guide bar. For this purpose, when the openings are stamped or milled out, small extensions can be left at the rim of the opening, which in an ensuing pressing operation are formed to the required dimension to become spacers.

Fastening the plates to the guide bar is advantageously done by welding or soldering, but can also be done by gluing or the like if the required strength properties of the connection can be attained in that way. The connection between the plates and the guide bar must be embodied such that during operation, a uniform introduction of force and transfer of force from the guide bar to the plates, and vice versa, can be effected, so that a guide bar having the strength properties of a solid guide bar is obtained.

Depending on the embodiment of the guide bar, it may be advantageous to provide only one elongated opening having two cover plates, or a plurality of openings arranged one next to the other having a corresponding number of cover plates. The weight reduction in such an embodiment may be up to thirty percent as compared with a solid guide bar.

BRIEF DESCRIPTION OF THE DRAWINGS

The invention will now be described with reference to the drawings, wherein.

DESCRIPTION OF THE PREFERRED EMBODIMENTS OF THE INVENTION

Figure 1:
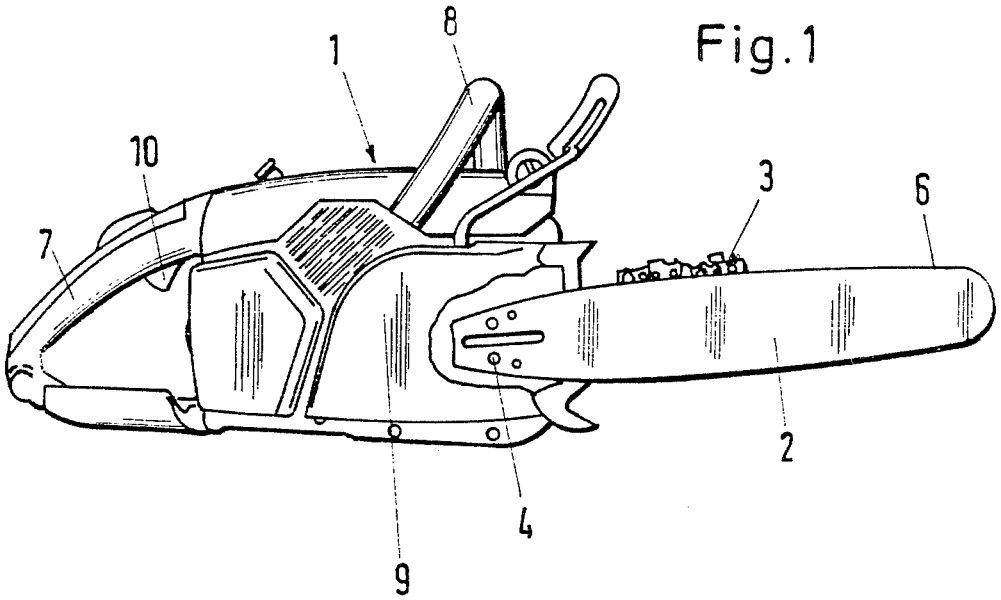
FIG. 1 is a side elevation view of a motor-driven chain saw equipped with a guide bar according to the invention.

In FIG. 1, a portable motor-driven chain saw 1 is shown on the front end of which an outwardly extending guide bar 2 for guiding a revolving saw chain 3 is mounted. The guide bar 2 is approximately sword-shaped and is rounded off at the front. At the end nearer the housing (the housing 9 is shown cut away in this area), the guide bar is provided with suitable mounting bores 4 at which the guide bar 2 is connected to the housing and drive part of the motor-driven chain saw 1.

The saw chain 3 is guided in a groove 5 of the narrow peripheral end face 6 of the guide bar 2 and is driven by means of a sprocket (not shown) in the region of the mounting bores 4 on the end of the guide bar 2 nearer the housing. In the embodiment shown in FIG. 1, the drive is effected by means of an internal combustion engine which is connected to the drive sprocket via a centrifugal coupling.

The drive unit (not shown) is disposed in the housing 9 of the motor-driven chain saw 1, which has a rear handle 7 and a front handle 8 for holding and guiding the tool. A gas switch 10 is disposed on the rear handle 7. After the switch is unlatched, it is used to control the engine rpm and hence the speed of the saw chain 3 on the guide bar 2. The forces transmitted to the chain saw during sawing are transmitted via the guide bar 2 and the drive unit (not shown) connected thereto to the housing 9 and the handles 7 and 8.

As the simplified drawing in FIG. 1 makes clear, even relatively slight holding forces, introduced for example via the rear handle 7, can lead to considerable loads, for example in the front region of the guide bar 2, via the long lever arm conjointly defined by the housing 9 and guide bar 2. To reliably transmit such forces without twisting or bending the guide bar 2 beyond its range of tolerance, increased requirements for the stability of the guide bar 2 are made as mentioned above. Especially in chain saws having a very long guide bar and in those for professional use, the guide bar 2 is made of solid material as in the embodiments described below.

Figure 4:
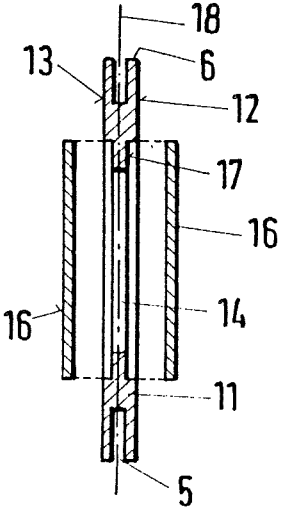
FIG. 4 is a section taken along the line IV—IV of FIG. 3 with the associated cover plates shown in spaced relationship to the guide bar main member.
Figure 7:
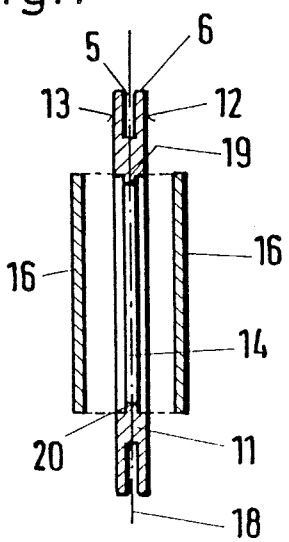
FIG. 7 is a section taken along the line VII—VII of FIG. 6 with the plates also shown.
Figure 10:
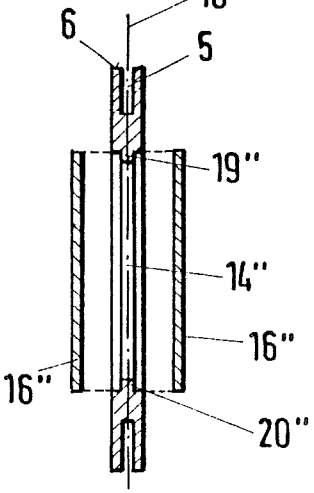

The guide bars shown in the drawings comprises a base plate 11 of steel having a thickness of 4.8 mm, for example. The base plate 11 has two flat sides 12 and 13 disposed parallel to one another which are connected together via the narrow end face forming the outer contour of the guide bar 2. As the sectional views of FIGS. 4, 7 and 10 show, the narrow end face 6 is, as is typical for such guide bars, interrupted by a groove 5 which surrounds the guide bar 2 on its top, front and bottom. The portions of the guide bar 2 that protrude beyond the groove bottom of the groove 5 may be provided, especially in the front turn-around or direction-changing region, with wear-resistant material or with a slip-on head having a direction-changing wheel.

Figure 2:
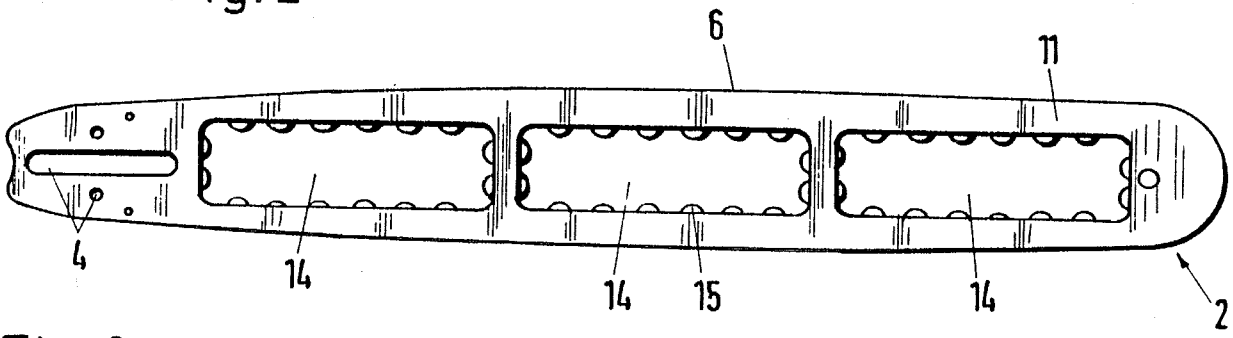
FIG. 2 is a side elevation view of the main member of a guide bar according to the invention shown without cover plates.
Figure 3:
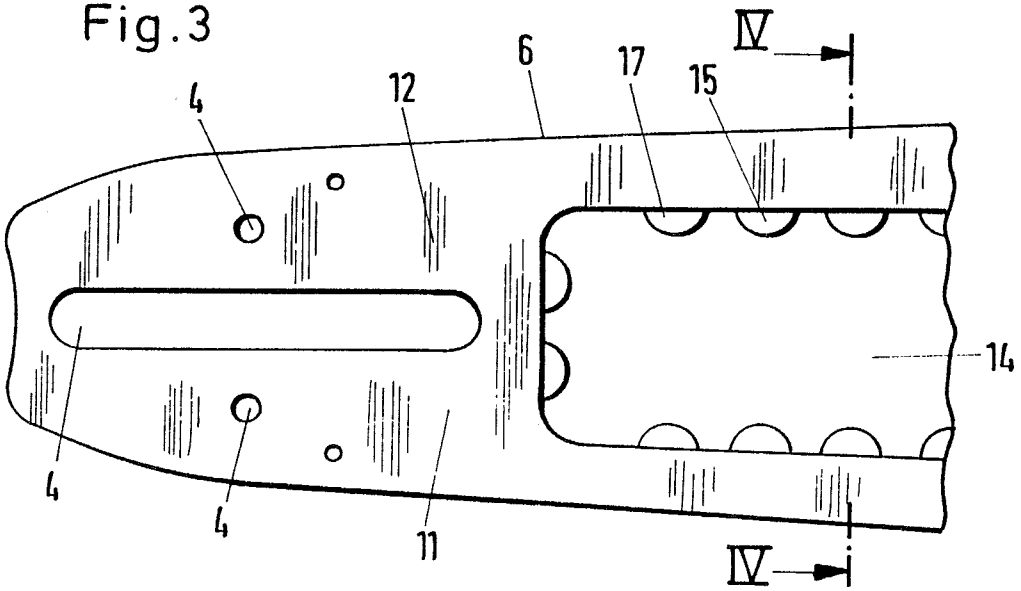
FIG. 3 is an enlarged view of the part of the guide bar of FIG. 2 nearer the housing again shown without cover plates.

The guide bar 2 shown in FIGS. 2 to 4 has three substantially rectangular openings 14, which extend through the base plate 11 of the guide bar 2. The openings 14 have protrusions 15 on their inside which serve as spacers for cover plates 16. The protrusions 15 are approximately semicircular in plan view (see FIG. 3), but may instead have virtually any arbitrary shape. As FIG. 4 shows, they are rectangular in cross section and on their flat sides 17 form bearing surfaces for the rim of the cover plates 16. FIG. 4 also shows that the protrusions 15 are disposed symmetrically with respect to the longitudinal plane of symmetry 18 of the guide bar 2.

The material thickness of the protrusions 15 determines the width of the hollow space that is formed by the opening 14 closed off by the cover plates 16. The protrusions 15 are distributed uniformly over the circumference of an opening 14 so that the cover plates 16 are supported as uniformly as possible by the protrusions.

The cover plates 16 comprise flat material and have an outer contour that matches the contour of an opening 14 so that they completely cover one opening 14 on each side and are flush with the corresponding flat side 12 or 13 of the base plate 11. Two cover plates 16 are provided for each opening 14 and are joined tightly to the base plate 11. In the completed guide bar shown in FIG. 1, the cover plates 11 have been welded to the base plate 11 and the guide bar 2 has been afterfinished such that completely even and smooth flat sides 12 and 13 of the guide bar are formed. This is important so that the guide bar can slide with as little resistance as possible in the kerf. By means of the welding seam extending in this embodiment over the entire periphery of the opening 14 and cover plate 16, a material connection is obtained between the cover plates 16 and base plate 11 by means of which the reaction forces occurring in the guide bar 2 are transmitted uniformly from the base plate 11 to the cover plates 16 and vice versa.

The hollow space between the cover plates 16 is located in the zone that is neutral in terms of bending, so that the stability of the guide bar 2 is not impaired. The openings 14 are spaced a sufficient distance away from groove 5 so that the groove region of the guide bar 2 is not adversely affected by the hollow spaces located therebeneath.

In the embodiment shown in FIGS. 2 to 4, the cover plates 16 and the base plate 11 are made from the same steel, and the material thickness of each cover plate 16 is approximately one-third the thickness of the base plate 11. In the embodiment shown, the cover plates 16 each have a thickness of approximately 1.6 mm. The weight reduction of the guide bar 2 described above is provided by the three hollow spaces and is approximately 25% in this embodiment as compared to a guide bar of solid material, with substantially the same stability properties, that is, bending strength and torsional strength.

Instead of the cover plates 16 made of the same material as the base plate 11, cover plates of higher alloy steel or other materials, which have better strength properties than the basic material, can be used; then the material thickness of the cover plates can be reduced still further without a loss of stability. This enables a further reduction in weight.

Figure 5:
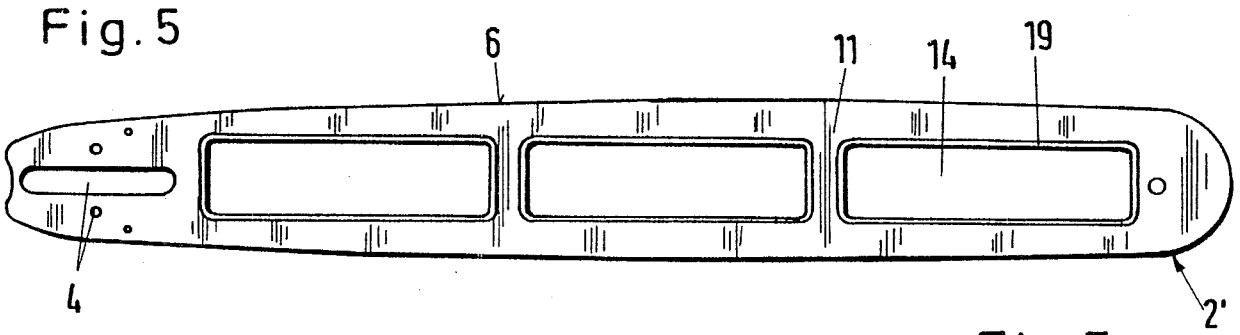
FIG. 5 shows the guide bar main member of a second embodiment of a guide bar according to the invention in a view corresponding to FIG. 2 (shown without cover plates)
Figure 6:
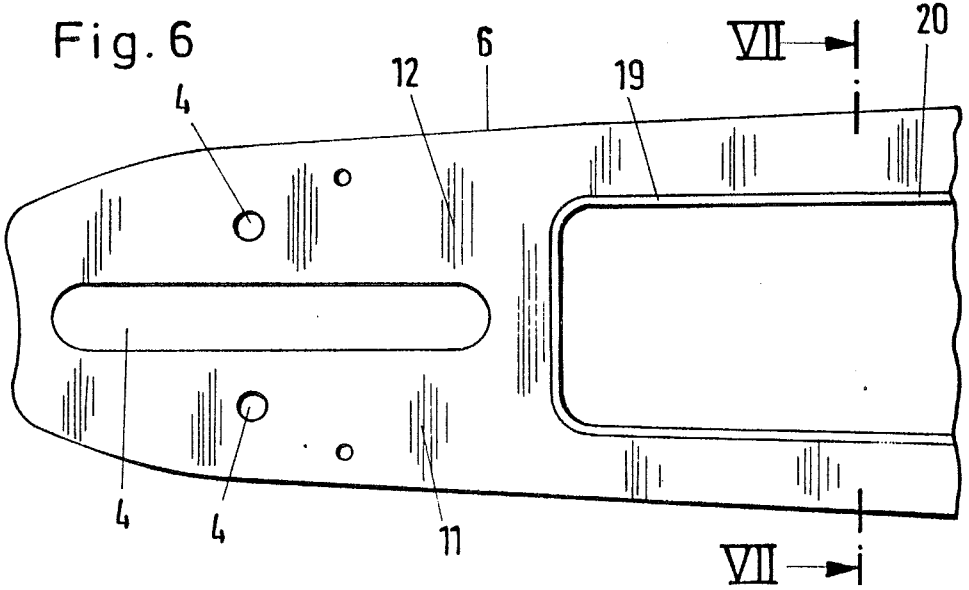
FIG. 6 is an enlarged view of the part of the guide bar of FIG. 5 nearer the housing again shown without cover plates.

FIGS. 5 to 7 show a second embodiment of a guide bar 2' which differs from the guide bar 2 of FIGS. 1 to 4 solely in having differently configured spacers in the openings 14. The spacers in this embodiment comprise a rim 19 extending about the inside of each opening 14. The rim 19 is disposed symmetrically with respect to the longitudinal plane of symmetry 18 and has a rectangular cross section. The flat sides of the rim 19, like the flat sides 17 of the first embodiment, are disposed so as to be parallel to the flat sides 12 and 13 of the guide bar 2' and form bearing surfaces for the cover plates 16. In this embodiment as well, the rim 19 in each opening 14 is configured and disposed such that the cover plates 16, when they rest on this rim, are flush with the flat sides 12 or 13 of the base plate 11. The rim 19 supports two mutually adjacent cover plates 16 with respect to each other and keeps the cover plates 16 in the intended location while they are being fastened (by welding, soldering or gluing) to the base plate 11. In addition, the rim 19 enlarges the connecting surface area between the cover plate and base plate; this is particularly advantageous when the cover plate is glued to the base plate because this considerably enlarges the gluing area and distributes the load on the glued locations in two planes that are at right angles to one another.

Figure 8:
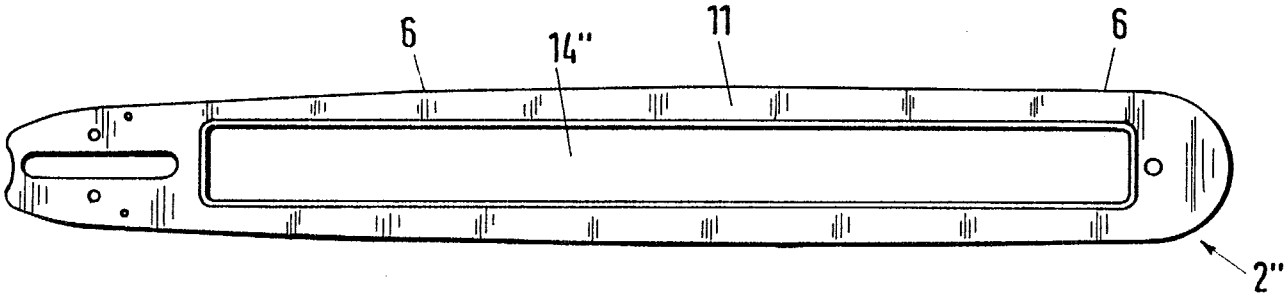
FIG. 8 shows the guide bar main member of a third embodiment of a guide bar of the invention in a view corresponding to FIG. 2 (shown without cover plates)
Figure 9:
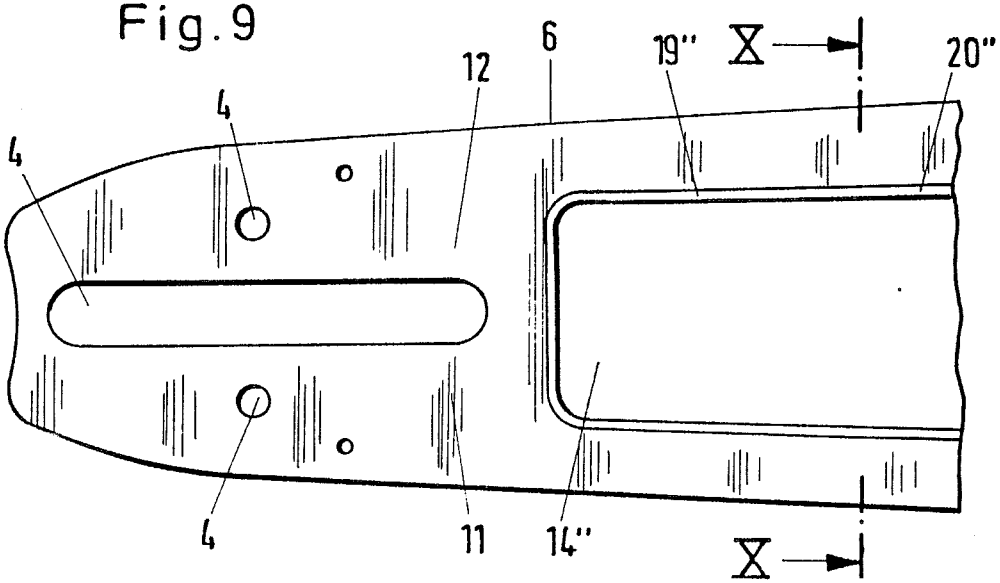
FIG. 9 is an enlarged view of the part of the guide bar of FIG. 2 nearer the housing again shown without cover plates; and, FIG. 10 is a section taken along the line X—X of FIG. 9 with the cover plates also shown.

FIGS. 8 to 10 show a third embodiment of a guide bar 2''. This embodiment differs from the second embodiment 2' in that instead of three openings 14, it has one elongated opening 14'' with two correspondingly configured elongated cover plates 16''. In this embodiment, the weight reduction as compared with the solid guide bar is approximately 30%, if the cover plates 16'' and the base plate 11 are made of the same material. The rim 19'' extending around the inside of the openings 14'' corresponds to the rim 19 of the previous embodiment and is configured correspondingly but adapted to the shape of the opening 14''.

The spacers 15, 19 and 19'' provided in the embodiments shown in FIGS. 2 to 10 may advantageously be stamped from the basic material of the base plate 11, which makes manufacture of the guide bar considerably less expensive. To stamp a rim 19 or 19'', first an opening 14 or 14'' is produced which is slightly smaller than the outer contour of the cover plate provided therefor. From the remaining excess material of the opening 14 or 14'' the rim 19 or 19'' can then be stamped in a pressing operation and, at the same time, the outer contour of the opening 14 or 14'' is spread wider to such an extent that the corresponding cover plate 16, 16'' can be laid therein.

In the first embodiment, which has protrusions 15 as the spacers, an opening 14 is first made, which has inwardly pointing protrusions of the same thickness as the base plate 11. In a further method step comprising a pressing operation, these protrusions are compressed to the required thickness of the protrusions 15, after which the cover plates 16 are inlaid and firmly joined to the base plate 11.

The spacers 15, 19 and 19'' described here are integrally formed with the base plate 11 and can be produced simply and inexpensively be reshaping; they also provide the very substantial advantage that they keep the cover plates 16 or 16'' in a defined and intended position in which the plates can then be fastened simply and quickly. To obtain an increased supporting action between the cover plates, it may also be advantageous not to configure the spacer integrally with the base plate but rather to fasten suitable reinforcing spacers in the openings 14, 14'' between the cover plates 16, 16''. In this situation, the protrusions 15 or rim 19, 19'' may be omitted as may be required.

As the above-described embodiments show, one or more openings may be provided, depending on the embodiment of the guide bar, and closed by suitably shaped cover plates. The openings are closed such that smooth and plane flat sides of the guide bars are produced. As a result, the guide bar can be reduced in weight by up to 40% as compared with a guide bar of solid material, without impairing its stability, because the hollow spaces are in the zone that is neutral with respect to bending (longitudinal plane of symmetry 18), so that the resistance moment of the guide bar is unchanged and remains high.

It is understood that the foregoing description is that of the preferred embodiments of the invention and that various changes and modifications may be made thereto without departing from the spirit and scope of the invention as defined in the appended claims.

What is claimed is:

1. A guide bar for guiding the saw chain of a chain saw comprising:

a main member having two flat sides and an outer peripheral edge region defining a guide groove for guiding the saw chain in its movement around the guide bar;

said main member having a predetermined thickness between said flat sides and having a clear-through opening formed therein; said main member having an inner peripheral edge defining said opening;

two cover plates for covering respective ones of said flat sides so as to be mutually adjacent and said cover plates having a combined thickness less than said predetermined thickness; and, protrusion means formed on said inner peripheral edge to define first and second seating means for receiving respective ones of said cover plates thereon, said first and second seating means being recessed relative to corresponding ones of said flat sides so as to cause the flat outer sides of said plates to be flush with corresponding ones of said flat sides of said main member to conjointly define a hollow space therebetween.

2. The guide bar of claim 1, the guide bar defining a longitudinally extending center plane; and, said main member and said cover plates conjointly defining a closed hollow space arranged symmetrically with respect to said center plane and having its largest dimension in said plane.

3. The guide bar of claim 1, said cover plates being made of the same material as said main member, and each of said cover plates having a material thickness of approximately one-third of the material thickness of the guide bar.

4. The guide bar of claim 1, wherein the guide bar is made of steel, said cover plates being made of a higher alloyed material than said main member; and, each of said cover plates having a material thickness which is less than one-third of the material thickness of the guide bar.

5. The guide bar of claim 1, said inner peripheral edge being defined by a peripheral edge portion of said main member; said protrusion means being a recessed rim stamped into said peripheral edge portion for receiving said cover plates thereon.

6. The guide bar of claim 1, said protrusion means being a plurality of recessed projections stamped into the periphery of each of said openings for receiving the corresponding one of said cover plates thereon.

7. The guide bar of claim 1, comprising joining means for tightly joining said cover plates to said main member.

8. The guide bar of claim 7, said joining means being selected from the group consisting of weld means, solder means and adhesive means.

9. The guide bar of claim 1, said openings being formed in said main member so as to extend over more than half of the length of said guide bar.

10. The guide bar of claim 1, said main member having a plurality of pairs of mutually adjacent openings formed in corresponding ones of said flat sides, said pairs of openings being disposed one next to the other along the length of said guide bar; and, a plurality of pairs of cover plates for covering the openings of said respective pairs of openings.

* * * * *

UNITED STATES PATENT AND TRADEMARK OFFICE

CERTIFICATE OF CORRECTION

PATENT NO. : 4,794,696

DATED : January 3, 1989

INVENTOR(S) : N. Apfel, H. Stehle and R. Kemmler

It is certified that error appears in the above-identified patent and that said Letters Patent is hereby corrected as shown below:

On the front page, under "Assignee": delete "Stihl Andreas," and substitute -- Andreas Stihl, -- therefor.

In column 4, line 43: delete "comprises" and substitute -- comprise -- therefor.

In column 5, line 14: delete "11" and substitute -- 16 -- therefor.

In column 6, line 44: delete "be" and substitute -- by -- therefor.

Signed and Sealed this

Tenth Day of October, 1989

*Attest:*

*Attesting Officer*

DONALD J. QUIGG

*Commissioner of Patents and Trademarks*